United States Patent [19]

D'Antonio et al.

[11] Patent Number: 5,051,605

[45] Date of Patent: Sep. 24, 1991

[54] SWITCH FOR ELECTRONIC SPORTS EQUIPMENT

[75] Inventors: Nicholas F. D'Antonio, Liverpool, N.Y.; Ehrenfried Andra, Farchant; Lorenz Stempfhuber, Oberau, both of Fed. Rep. of Germany

[73] Assignee: Marker International, Salt Lake City, Utah

[21] Appl. No.: 299,970

[22] Filed: Jan. 19, 1989

Related U.S. Application Data

[63] Continuation-in-part of Ser. No. 38,491, Apr. 15, 1987, abandoned, which is a continuation of Ser. No. 586,103, Mar. 5, 1984, abandoned, which is a continuation of Ser. No. 367,580, Apr. 12, 1982, abandoned.

[51] Int. Cl.[5] ..... A63C 9/08

[52] U.S. Cl. ..... 307/116; 307/119; 280/612; 280/611

[58] Field of Search ..... 307/116, 119, 120; 361/179-181; 280/611-613

[56] References Cited

U.S. PATENT DOCUMENTS

| | | | |
|---|---|---|---|
| 3,758,855 | 9/1973 | Meyer | 331/65 |
| 3,764,861 | 10/1973 | Orris | 361/203 |
| 3,892,980 | 7/1975 | Anderson | 307/116 |
| 3,919,563 | 11/1975 | Lautier et al. | 280/612 |
| 3,944,843 | 3/1976 | Vaz Martins | 307/116 |
| 3,992,948 | 11/1976 | D'Antonio et al. | 73/432 R |
| 4,104,595 | 8/1978 | Overzet | 331/65 |
| 4,140,331 | 2/1979 | Salomon | 280/612 |
| 4,291,894 | 9/1981 | D'Antonio et al. | 280/612 |
| 4,310,807 | 1/1982 | McKee | 331/65 |
| 4,444,411 | 4/1984 | Svoboda et al. | 280/611 |
| 4,502,146 | 2/1985 | D'Antonio | 307/116 |

FOREIGN PATENT DOCUMENTS

| | | | |
|---|---|---|---|
| 2705174 | 8/1977 | Fed. Rep. of Germany | 280/612 |

*Primary Examiner*—Todd E. Deboer

*Attorney, Agent, or Firm*—D. Peter Hochberg; Mark Kusner; Louis J. Weisz

[57] ABSTRACT

A continuously energized switch having only stationary parts for application to electronic sports equipment is disclosed. The switch connects and disconnects the electronic circuitry of the sports equipment to and from its power supply in response to the application of predetermined non-invasive external influences.

6 Claims, 6 Drawing Sheets

SWITCH FOR ELECTRONIC SPORTS EQUIPMENT

This is a continuation-in-part application of prior application Ser. No. 038,491, filed Apr. 15, 1987, which latter application was a continuation of application Ser. No. 586,103, filed Mar. 5, 1984, which latter application was a continuation of application Ser. No. 367,580, filed on Apr. 12, 1982 which are all abandoned.

BACKGROUND OF THE INVENTION

As a result of technological advances in the high density integration of solid state circuits and the economical production of sophisticated microprocessors, microcircuits are being employed in an increasing variety of applications. Electronic circuitry is being added to consumer goods to perform functions not previously available and to complement or improve existing functions. An example is the use of microcircuits in sporting goods. A particular example is the use of electronic signal evaluation, decision-making and release command circuitry in a safety ski binding. Such an electronic safety ski binding is described in U.S. Pat. No. 4,291,894 of D'Antonio et al. The electronic safety ski binding there described includes a mechanical portion which, in its locked condition, grasps a skier's boot and, in its released condition, permits the ski boot to be separated from the binding. The released condition is ideally achieved during skiing when skiing forces threaten the safety or well-being of the skier. The function of the mechanical portion of the safety ski binding is complemented, as described in the cited patent, by electronic circuitry which senses and monitors the skiing forces, with transducers continuously evaluating them to determine if the skier is endangered and commands the mechanical portion of the binding to release, i.e., to switch from its locked to its released condition, when a situation dangerous to the skier is encountered. Another example of an application of electronic circuitry in sporting goods is in underwater diving equipment. There, the harshness of the environment and the necessity of isolating the circuitry from that environment is obvious.

Before sporting goods incorporating electronic circuitry can be used, the circuitry must be actuated or turned "on" in order to connect a power source to the electronic circuitry. Electrical switches for electronic sporting goods are described in U.S. Pat. No. 4,140,331 of Salomon. The switches there described include at least one mechanical, movable part controlling the connection of the circuitry and power supply. However, in the harsh environment experienced by sporting goods and, particularly, ski bindings, it is desirable to avoid mechanical and movable parts. Such parts imply the presence of sliding and/or contacting surfaces which are a source of difficulty, and which should desirably be eliminated to avoid the adverse effects of mechanical shock, as well as to protect the circuitry and the contacting members against the intrusion of foreign matter. Accordingly, it is desirable to provide an electronic switch which as no moving parts for activating the electronic circuitry in sporting goods.

SUMMARY OF THE INVENTION

In the present invention, a switching subsystem or switching module is provided which incorporates an electronic switch control means and an electronic switch. The electronic switch connects or disconnects the power source from the electronic circuitry to which it provides power for its intended operation. Since the switching subsystem incorporates electronics which must be constantly prepared to turn the electronic circuitry "on," some electrical power is continuously consumed by it. However, by constructing the inventive subsystem and its electronic switch from conventional CMOS circuits, its power consumption is negligible.

The electronic switch is actuated by electronic switch control means which is responsive to a non-invasive external influence. The control means maybe oscillator-based so that an external influence, such as pressure, will change the tuning of the oscillator or of a filter receiving the output signal of the oscillator. The resultant frequency shift appears as a changed signal level at the filter output which activates or deactivates the electronic switch.

Another embodiment of a switch according to the invention includes, as an electronic switch control means, a piezoelectric crystal which generates a voltage in response to a mechanical shock. The shock-generated voltage ultimately causes the electronic switch to close thereby connecting the power source to the electronic circuitry.

Still another embodiment of the inventive switch includes an inverter and a resistor network as the on-off control means. A change in the network impedance at the input of the inverter brought about by a change in an external influence causes the output signal of the inverter to change states, thereby directing the electronic switch to assume its "on" or "off" position.

Thus the present invention relates to electronic sports equipment that includes means for controlling the electrical energy from a power source to electronic circuitry that must be energized to perform its intended function. An electronic switch, that is, one that has stationary ports and is actuable, "turned on", only by electronic signals, determines whether the electronic circuitry is electrically connected to the power source. Actuation of the electronic switch is controlled by electronic switch control means so as to transmit electrical power to the circuitry only when the equipment is in use.

DETAILED DESCRIPTION OF PREFERRED EMBODIMENTS

In the present invention, an electronic switch that incorporates stationary parts, i.e., does not incorporate conventional moving contacts, is provided for electronic sports equipment. The switch is actuated by various external influences which may involve relative movements of objects but no electrical contacts. The inventive switch itself does not incorporate any movable parts, i.e., parts which pivot or otherwise cause the mechanical closing of electrical contacts. The term "stationary parts" as used here, includes deformable parts, i.e., parts which may change in dimension in response to the application of pressure to them, but which do not mechanically close or open electrical contacts as a result of the deformation. With the definition of the term "stationary parts" thus understood, the switch according to the present invention includes only stationary parts and is free from the difficulties experienced in using switches which incorporate moving contacts in a harsh sports equipment environment.

Figure 1:
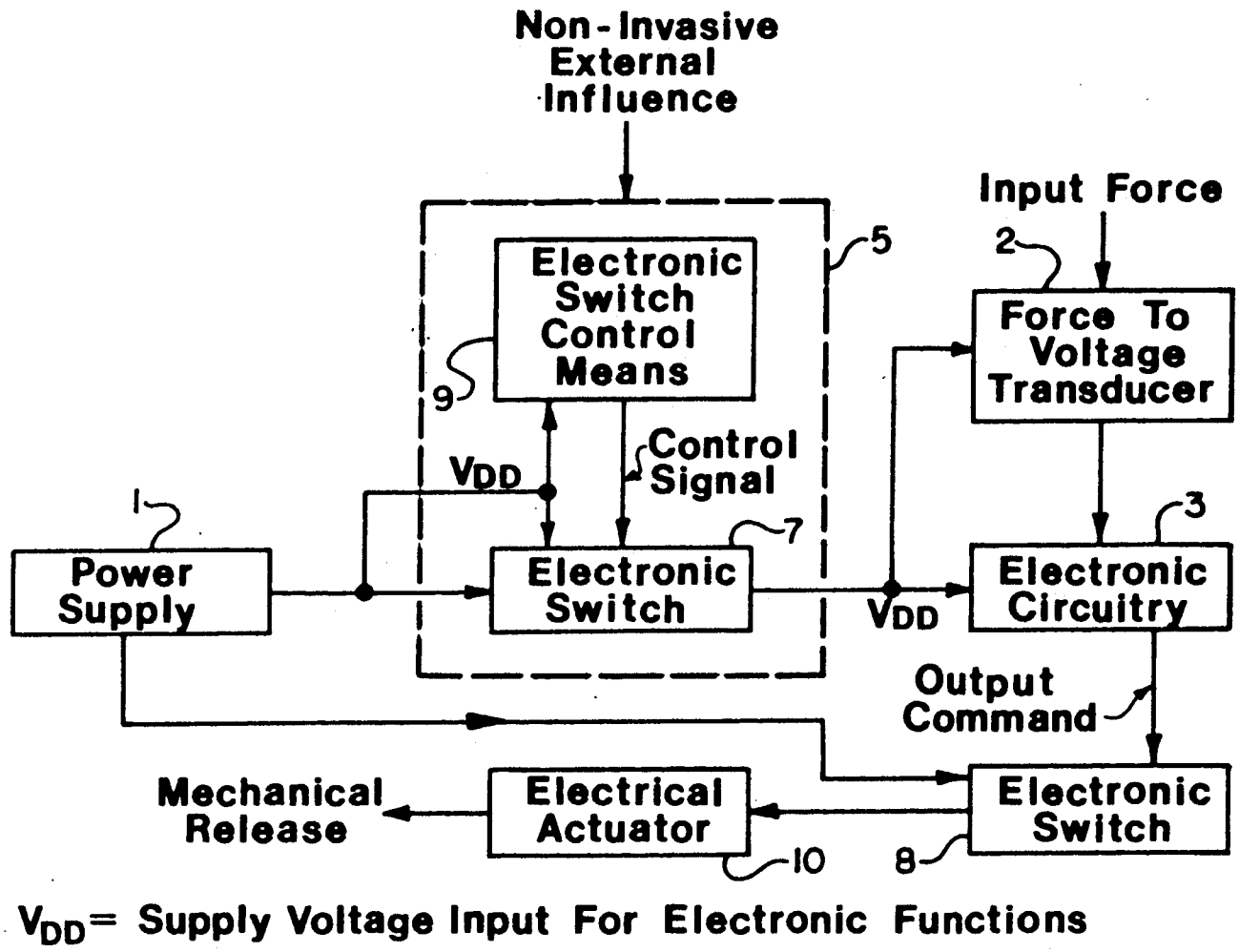
FIG. 1 is a schematic, block diagram of a switch and the circuits it powers according to the invention.

In FIG. 1, a schematic block diagram of the switching system according to the invention is depicted. A power supply 1 provides perpetual, that is continuous, supply voltage $V_{DD}$ and its return $V_{SS}$ as defined in conventional integrated circuit terminology, to the electronic switching module 5 shown within the broken lines and which includes electronic control means 9 and the controlled electronic switch 7. When switch 7 closes, power supply 1 sends the source voltage $V_{DD}$ to the operating system, i.e., in the case, transducer 2 and processing electronic circuitry 3 which represent the transducer and processing functions shown in FIGS. 13–19 of previously referenced U.S. Pat. No. 4,291,894, incorporated by reference herein. Also included in FIG. 1 are electronic switch 8, for example, the switch 8 of FIG. 13 in '894, and an electrical actuator 10, for instance, the actuator 10 of FIG. 13 in '894. The opening and closing of electronic switch 7 is responsive to electronic switch control means 9, which itself is controlled by a non-invasive electrically isolated external influence. By "non-invasive" is meant that there are no external current carrying connections or conductors involved in producing the required changes in switch control means 9. Electronic switch 7 is a conventional electronic switch, such as a CMOS CD4066 or similarly operating bi-directional electronic switch, which as long as the $V_{DD}$ supply voltage and $V_{SS}$ ground terminals are connected to a power source, will serve to open or close the electrical thru-put path between its terminals, depending upon the signal level appearing at its control input terminal. In a system such as an electronic ski binding, it is advantageous to use small sized batteries that may be inadequate directly to provide sufficient energy for operating some of the applicable forms of the electrical actuator 10. In such cases, a stored energy function 4 will first store, and subsequently release energy many times greater than that available directly from power supply 1 at the instant the release command closes electronic switch 8. Stored energy function 4 could, for example, be provided by one or more appropriately sized capacitors.

Figure 2:
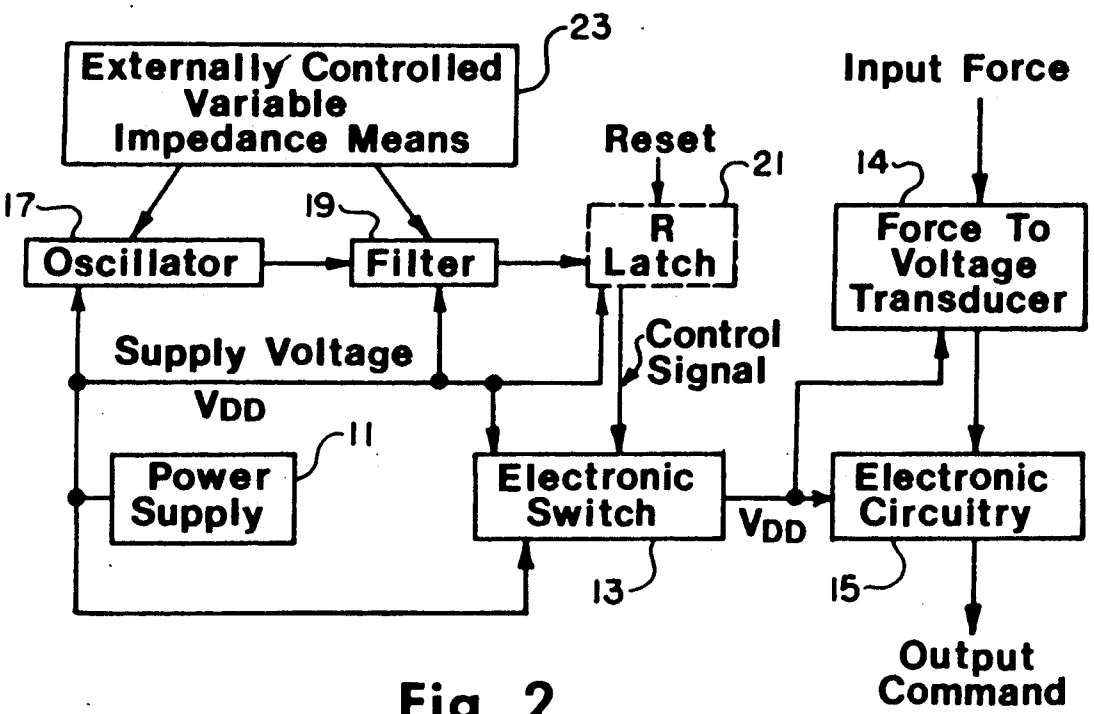
FIG. 2 is a schematic, block diagram of an embodiment of a switch and the circuits it powers according to the invention.

In FIG. 2, an embodiment of the switch of FIG. 1 is shown in which the electronic switch control means 9 referred to in FIG. 1, incorporates a non-invasive, externally controlled variable impedance means 23, an oscillator 17, a filter 19 and an optional latch 21. A power source supplies a continuous supply voltage $V_{DD}$ to oscillator 17, active filter 19, latch 21 and electronic switch 13, and provides a sufficient level of electrical current for the operation of transducer 14 and processor 15 when switch 13 closes, i.e., changes from the high impedance throughput state to the low impedance thru-put state. The output signal of filter 19 is applied through an optional latch means 21 to the control terminal of electronic switch 13 to control the state, i.e., whether closed or open, of electronic switch 13. An externally controlled, non-invasive, variable impedance means 23 is incorporated into either oscillator 17 or filter 19 for changing the value of impedance in response to the external influence. Among others, one type of such external influence on the resistive component of the oscillator, for which no power source is needed, is a magnet located in the movable heel cup of the binding and an appropriately located magneto resistance connected to the oscillator. The impedance change causes the frequency of oscillator 17 to shift or the frequency response characteristic of filter 19 to shift. Such shifting can cause the state of the signal to the control terminal of electronic switch 13 to change, opening or closing electronic switch 13.

Figure 3A:
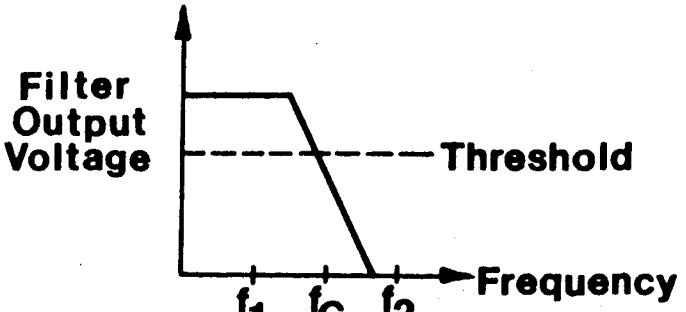
FIG. 3A shows a response curve as a function of frequency for a low pass filter.
Figure 3B:
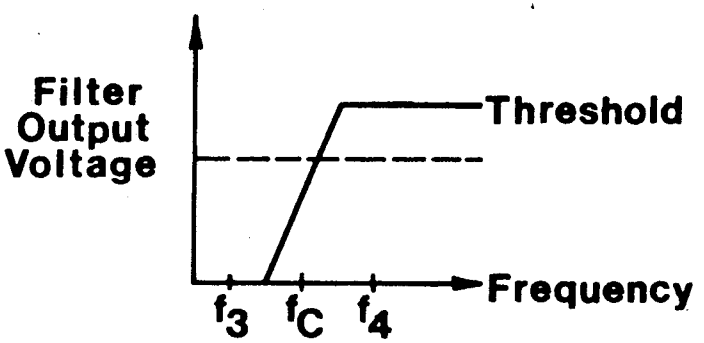
FIG. 3B shows a response curve as a function of frequency for a high pass filter.

The change in the magnitude of the output signal of filter 19 is illustrated in FIG. 3 for situations in which filter 19 is either a low pass or a high pass filter. In FIG. 3A, the familiar linearized response characteristic of a low pass filter is shown. For a fixed amplitude input signal of variable frequency applied to the filter, an output signal appears which, above a certain frequency, especially above cut-off frequency, $f_c$, has a much lower amplitude than does the input signal. Input signals with frequencies below $f_c$ are not attenuated appreciably by the filter. A threshold output signal amplitude is indicated in FIG. 3A, the threshold referring to the control signal amplitude which, when applied to the control terminal of electronic switch 13, determines the state of electronic switch 13. Signals above the threshold amplitude cause switch 13 to be in one state (e.g., closed), while amplitudes below the threshold cause electronic switch 13 to be in its other state (e.g., open). If oscillator 17 of FIG. 2 is operating at frequency $f_1$ of FIG. 3A, the output signal from filter 19 is above the threshold. However, if variable impedance means 23 is incorporated in oscillator 17 and causes the frequency of oscillator 17 to shift in response to the external influence to frequency $f_2$ of FIG. 3A, then the filter output signal drops below the threshold level. In this manner, electronic switch 13 can be opened and closed in response to a predetermined form of external influences. Likewise, as shown in FIG. 3B, the same result can be achieved with a high pass filter, the threshold being exceeded when the frequency of oscillator 17 rises from $f_3$, below the cut-off frequency, to $f_4$, above the cut-off frequency.

FIGS. 3A and 3B have been described as if a shift in oscillator frequency provided electronic switch control. The same response, however, can be achieved through shifting the cut-off frequency of the filters by including the variable impedance means 23 in filter 19, rather than in oscillator 17. In that event, the cut-off frequency, $f_c$, would again shift between $f_1$ and $f_2$ in FIG. 3A, and between $f_3$ and $f_4$ in FIG. 3B, to change the state of electronic switch 13.

Figure 4B:
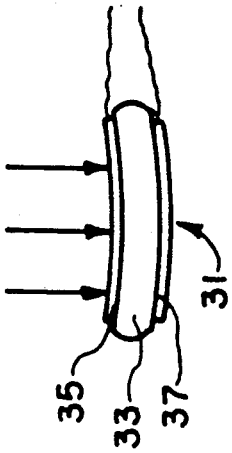
FIG. 4B depicts in cross-section a capacitor under the influence of pressure, which forms a part of a control means according to an embodiment of the invention.
Figure 4A:
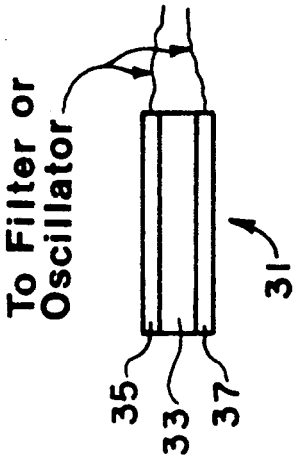
FIG. 4A depicts in cross-section a capacitor free of the influence of pressure, which forms a part of a control means according to an embodiment of the invention.

In FIG. 4, an example of an embodiment of an externally controlled variable impedance means 23 is illustrated. A capacitor 31 has an elastic dielectric material 33 disposed between its plates 35 and 37. Plate 37 is firmly supported, but plate 35 is deformable or supported only by dielectric 33. As illustrated in FIG. 4B, pressure applied transversely to the two plates reduces their separation over at least part of their area, thereby raising the capacitance of the capacitor. If capacitor 31 is part of oscillator 17, the change in its capacitance changes the output frequency of the oscillator. If capacitor 31 is part of filter 19, the change in its capacitance changes the cut-off frequency of the filter. In either event, the state of electronic switch 13 may be changed by selecting the cut-off frequencies and frequency shifts in a manner obvious to one skilled in the art.

Figure 5:
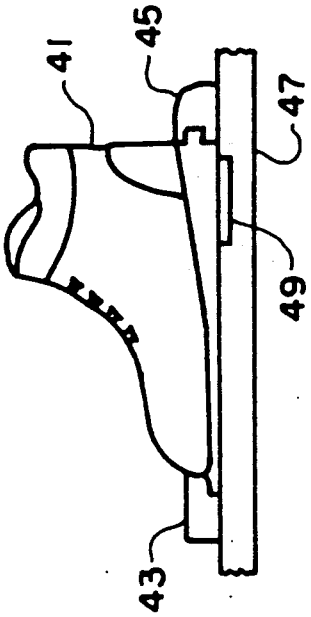
FIG. 5 is a schematic cross-sectional view of a ski boot gripped by a ski binding including embodiments of the inventive switch.

In application to a ski binding, the pressure on capacitor 31 may be provided by the weight of the skier. Capacitor 31 may be mounted on a binding where the force of a ski boot will result in its compression. By way of further illustration, FIG. 5 shows, in cross-section, a ski boot 41, clamped by a top clamp 43 and a heel clamp 45 in a ski binding. The binding includes a mounting plate 47, such as a ski on which an element 49, which may be capacitor 31, is located. The weight of the skier, through the heel of the boot, compresses the capacitor plates which causes a triggering of the electronic switch. In a ski binding, it is important to avoid changing the "on" state of electronic switch 13 during skiing when weight may momentarily be absent from the boot heel to a severe shock, for example, during a jump or strong forward thrust. To achieve this result, the optional latch means 21 of FIG. 2 may be included in the circuit. As explained elsewhere in this description, latch means 21 maintains a fixed output signal once the proper input signal is received, regardless of subsequent changes in the input signal. Latch means 21 can only be reset by applying a signal to the reset terminal of the latch.

In applications other than ski bindings, latch means 21 may not be needed. For example, in diving equipment, the capacitor embodiment of the environmental variable impedance means could be sensitive to water pressure so that so long as the equipment remained submerged, electronic circuitry 15 would remain "on." If the electronic circuitry needed only operate during submersion when water pressure will be present, no latch means is necessary.

Another embodiment of an environmentally variable impedance means 23 can be constructed from a resistor having a resistance which depends upon the mechanical pressure exerted on it. One such variable conductance elastomer is sold under the trademark "Pressex", and in the absence of pressure, the material acts as an open switch. Application of sufficient pressure compressing the material causes it to act as a closed switch. Thus, a pressure sensitive switch having only stationary parts may be formed to provide a change in impedance.

Figure 6A:
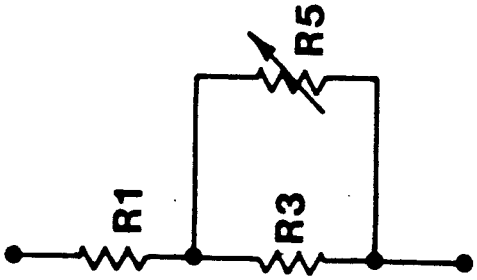
FIG. 6A presents a schematic diagram of a resistor network for inclusion in a control means for switch closure according to embodiments of the invention.
Figure 6B:
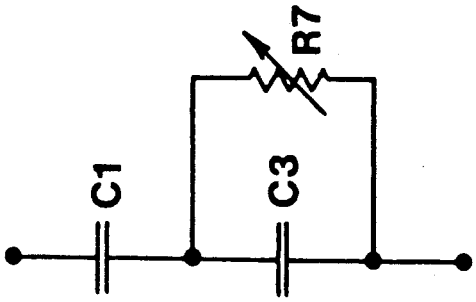
FIG. 6B presents a schematic diagram of a resistor-capacitor network for inclusion in a control means for switch closure according to embodiments of the invention.

In FIG. 6A, resistor $R_1$ is connected in series with resistor $R_3$ and pressure-sensitive resistor $R_5$, the latter shunting resistor $R_3$. Resistor $R_5$ may also be formed from "Pressex", or similar material, and may be incorporated in a ski binding as element 49 of FIG. 5. When ski boot 41 is present and the skier's weight is applied to resistor $R_5$, that "resistor" essentially short circuits resistor $R_3$ causing a shift in the cut-off frequency of a filter if the resistors are part of a filter, or a shift in frequency of an oscillator if the resistors form part of the oscillator's tuning circuit. The same variable resistance network is applicable to diving equipment. Likewise, in FIG. 6B, a resistor $R_7$ formed of "Pressex," or similar material, shunts a capacitor $C_3$ which is connected in series with a capacitor $C_1$. When sufficient pressure is applied to resistor $R_7$, it short circuits capacitor $C_3$. Thus, the capacitance presented across the terminals in FIG. 6B is either that of capacitor $C_1$, or the series combination of $C_1$ and C3, depending upon the resistance of resistor $R_7$. Again, the variable capacitance may be part of a filter or of an oscillator's tuning circuit, causing a shift in a response characteristic or of frequency which translates into a critical change in the control signal applied to electronic switch 13. The variable capacitance means of FIG. 6B is applicable to ski bindings and diving equipment as previously described.

As FIG. 2 makes clear oscillator 17 and filter 19 if of the active type, and electronic switch 13 must be continuously energized or, at least, energized when it is intended that transducer networks 14 and electronic circuitry 15 may be turned on and off by a well-controlled, predetermined, non-invasive external influence. It is preferable that such components be continuously energized so that there is no possibility that another switch or preparatory step, which could be forgotten, is necessary to activate transducer 14 and electronic circuitry 15. By constructing the electronic switch and oscillator from CMOS components, the power continuously consumed an be minuscule. For example, an oscillator built from a CD 40106 model Schmidt trigger inverter and the switch from a CD 4066 bilateral switch would consume a total quiescent current of only about 0.02 microamperes at 5 volts at 25° C., or less than 1 microampere at 5 volts and −40° C., i.e., a maximum power of 5 microwatts in the static mode. A battery rated at 0.5 ampere-hours can theoretically supply such a power for several years of operation. Moreover, lithium cell batteries tend to "fall asleep" unless there is a minimal constant current flow. Thus, the continuous power consumption required by switch modules according to the present invention is minimal, not detrimental to battery life, and may even be beneficial.

Figure 7:
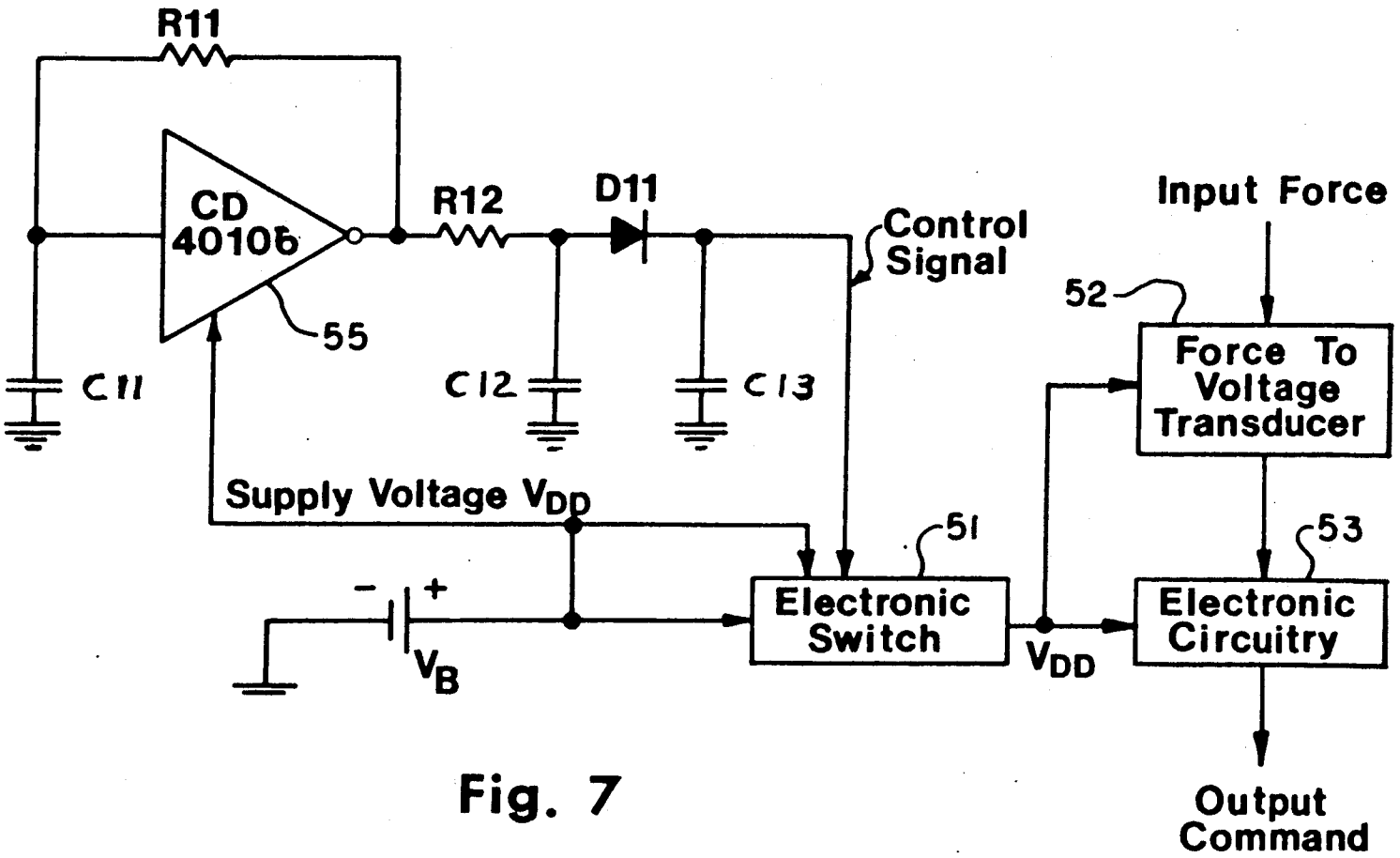
FIG. 7 is a schematic diagram of an embodiment of a non-invasive switch control network and the circuits it powers according to the invention.

In FIG. 7, a schematic circuit diagram of an embodiment of a switch according to the present invention is shown. The power supply is in the form of a battery $V_B$ which continuously powers electronic switch 51 and then through the switch when closed, to power the transducer 52 and electronic circuitry 53. A conventional CMOS inverter 55 such as a CD 40106 has a feedback resistor $R_{11}$ and, connected from its input terminal to ground, a capacitor $C_{11}$. Thus, inverter 55 with resistor $R_{11}$ and capacitor $C_{11}$ from a well-known oscillator circuit. The output of the oscillator is connected in this case to a simple non-active low pass filter comprising a series resistor $R_{12}$, the opposite terminal of which is grounded through a capacitor $C_{12}$. The junction of $R_{12}$ and $C_{12}$ is connected to the anode of a diode $D_{11}$, the cathode of which is grounded through a capacitor $C_{13}$. Diode $D_{11}$ and capacitor $C_{13}$ form a peak detector which detects and stores on $C_{13}$ a voltage approximately equal to the amplitude peak of the voltage that appears on $C_{12}$. Diode $D_1$ prevents discharge of $C_{13}$ into $C_{12}$ and $R_{12}$, thereby more precisely transmitting changes in magnitude of the filter output signal to electronic switch 51. The voltage on capacitor $C_{13}$ is applied directly to the control terminal of electronic switch 51.

Either one of capacitors $C_{13}$ or $C_{12}$ or one of resistors $R_{11}$ or $R_{12}$ could comprise a non-invasive externally controlled variable impedance means as previously described. The variation of the value of the variable impedance tunes the oscillator or the cut-off frequency of the filter, so that the external influences, e.g., the application or removal of the skier's weight, the submersion or surfacing of diving equipment, can cause electronic switch 51 to switch transducer 52 and electronic circuitry 53 on and off.

While the foregoing discussion described simple filters with single frequency breakpoints, more complex filters having a number of frequency breakpoints can also be used to advantage and are within the scope of the invention.

Figure 8:
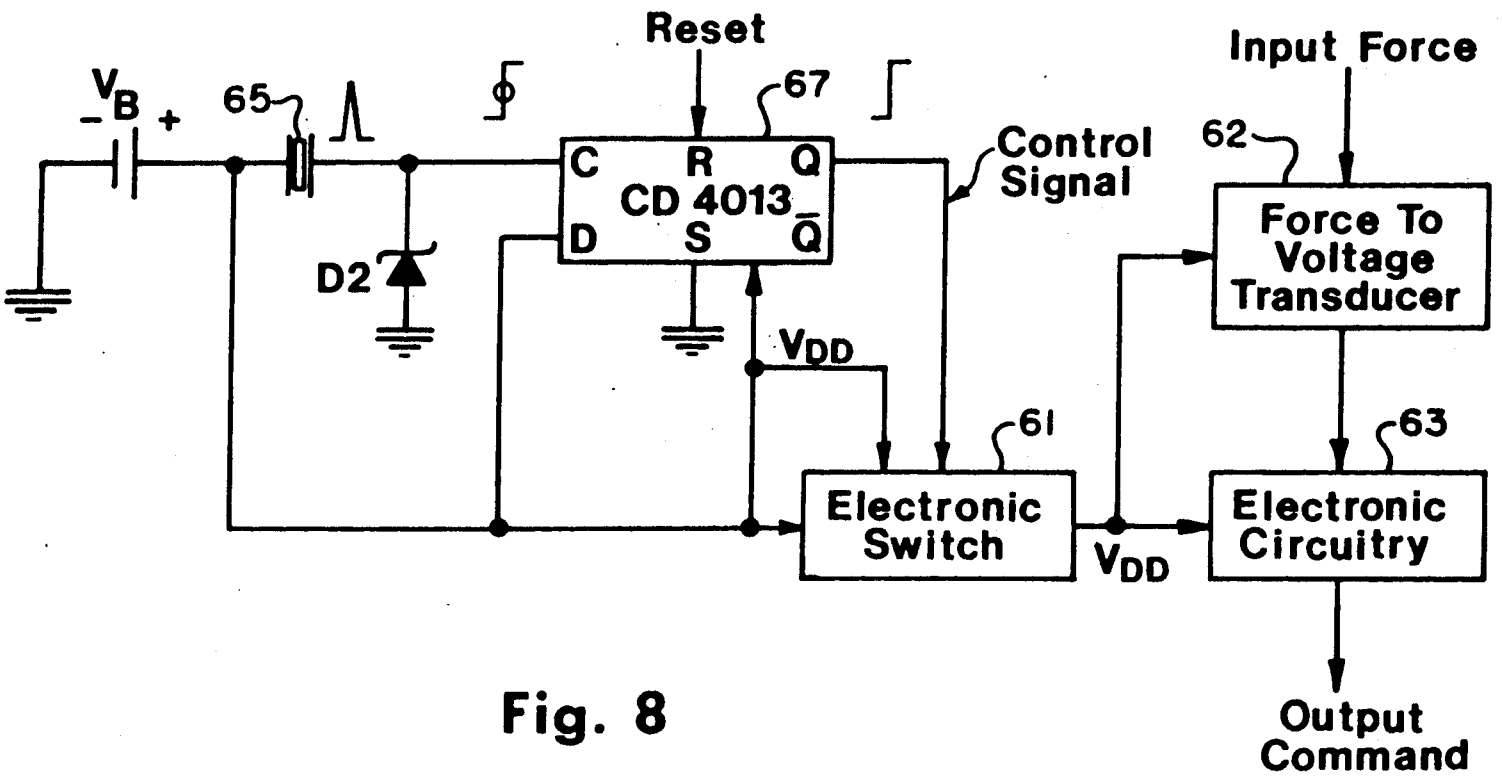
FIG. 8 is a schematic diagram of an embodiment of a non-invasive switch control network and the circuits its powers according to the invention incorporating a piezoelectric device.

Another embodiment of a switch according to the present invention is shown in FIG. 8. This embodiment does not employ an oscillator; rather, the electronic switch control means comprises a piezoelectric device. The power supply, again $V_B$, provides continuous power to electronic latch 67, electronic switch 61, and through switch 61 when closed, to transducer 62 and electronic circuitry 63. $V_B$ is also connected to one terminal of piezoelectric device 65. The other terminal of device 65 is connected to a clock terminal C of a latch means in the form of a D-type CMOS flip-flop 67, such as a CD4013. Input data terminal; D of flip-flop 67 receives the power supply voltage from $V_B$. The Q output terminal of flip-flop 67 is connected to the control terminal of electronic switch 61. Terminal S of flip-flop 67 is grounded and terminal R is prepared to receive a reset signal when needed. The cathode of a zener diode $D_2$ is connected to terminal C of flip-flop 67 and its anode is grounded.

Piezoelectric device 65 is preferably a modern titanate bearing ceramic material which produces a voltage in response to a mechanical shock. In modern piezoelectric devices this voltage can be very high; zener diode $D_2$ acts to limit the voltage received by clock terminal C of flip-flop 67 and to prevent damage to the flip-flop. When the switch is first awaiting a turn-on stimulus, the output signal of flip-flop 67 at terminal Q is in its low state. When a piezoelectric voltage large enough to clock flip-flop 67 is produced and received at clock input terminal C of flip-flop 67, the output signal at terminal Q of flip-flop 67 switches to its high state, causing electronic switch 61 to change state. Thereafter, changes in the input voltage at terminal C have no effect on the state of the signal at the Q terminal so long as no reset signal is received at terminal R of flip-flop 67. That is, flip-flop 67 acts as a latch, holding the command from device 65 and allowing continuous activation of electronic switch 61 so long as the flip-flop remains latched. The output signal at terminal Q is reset to its low state when a reset pulse is applied to terminal R of flip-flop 67. The reset signal may be provided by electronic processing circuitry 63 when some critical event is experienced. For example, in a ski binding, the releasing of the binding, either voluntarily by a skier at the end of a ski run, or involuntarily to prevent injury to the skier, would be an appropriate time for resetting the Q terminal signal to its low state.

When the piezoelectric embodiment of the switch is used in a ski binding, the insertion of a boot in the binding may be the source of the mechanical shock turning the switch "on." In the illustration of FIG. 5, element 49 could be the piezoelectric device, the heel of boot 41 generating the actuating shock. Of course, during skiing various other mechanical shocks are generated. In order to avoid repeated switching in response to these shocks, the latch means is provided. In addition, since the output signal of piezoelectric device 65 is transitory, the latch means "freezes" that signal to keep electronic switch 61 actuated after the stimulating signal has fallen to zero.

The same type of a flip-flop latch means, could be used as the latch means 21 of FIG. 2. In embodiments of the invention in which a switch is actuated by a skier's weight, the latch means maintains the electronic circuitry "on" when the skier jumps or the skis vibrate during skiing, by functioning in the manner described in connection with the piezoelectric embodiment.

Figure 9:
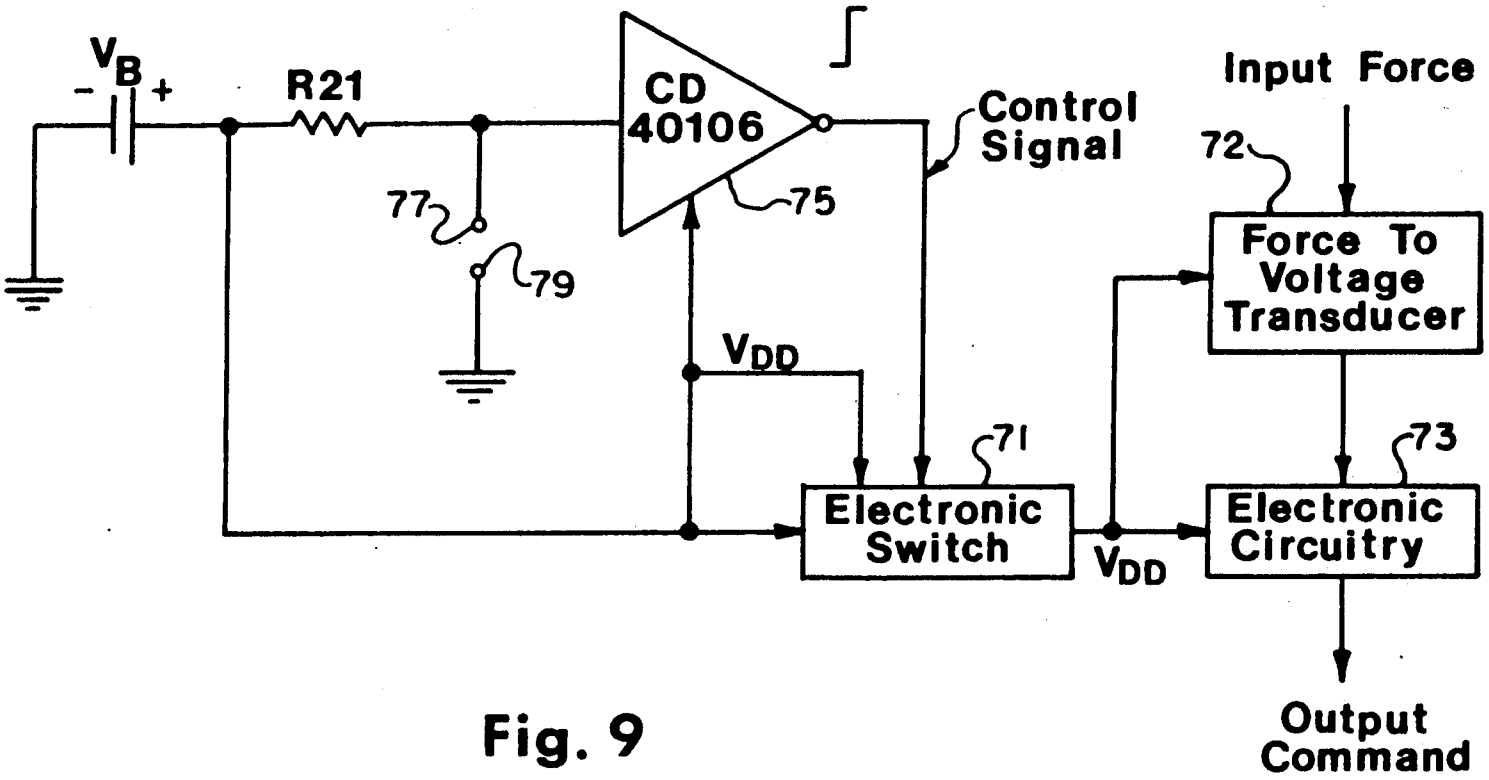
FIG. 9 is a schematic diagram of an embodiment of a switch control network and the circuit functions it powers according to the invention incorporating an inverter.

Yet another embodiment of a switch according to the invention is shown schematically in FIG. 9. There, power supply $V_B$ provides continuous power to a CMOS Schmidt trigger inverter 75, electronic switch 71, and when switch 71 is closed, to the transducer 72 and electronic circuitry 73. The power supply is connected through a resistor $R_{21}$ to inverter 75. The output of inverter 75 is connected to the control terminal of electronic switch 71. Also shown connected to the input of inverter 75 is a wire which contains a pressure variable resistance designated $\Delta R$ having terminals 77 and 79, terminal 79 being grounded. When the input voltage to inverter 75 is high, its output signal is low and vice versa. The characteristics of inverter 75 are chose so that voltage $V_B$ represents a high level signal and a fraction of $V_B$, e.g., approximately one-half $V_B$, represents a low level signal. When $\Delta R$ is unloaded and residing at its high resistance state across terminal 77 and 79, most of the $V_B$ voltage is applied to the input of inverter 75. When a lower impedance occurs across the terminal 77 and 79, the input voltage to inverter 75 drops, since $R_{21}$ is in series with the formerly very high resistance path to ground. If the impedance connected across the terminals is small enough such as that provided by the compression of a "Pressex", or similar type pad at 49 of FIG. 5, the input voltage to inverter 75 will change sufficiently to cause the output signal of inverter 75 to go high, actuating electronic switch 71. By choosing the resistance of $R_{21}$ to be very high, e.g., 10 megohms, the connection across terminals 77 and 79 need only be what might normally be considered a leakage path having an impedance of 2 megohms or so, in its reduced state in order to switch the state of the output signal of inverter 75. In diving equipment, the 77–79 connection need only be exposed terminals which are closed by the conductivity of water when the equipment is submerged. In a ski binding, element 49 of FIG. 5 can be connected to terminals 77 and 79 to interface with the surface of sole plate 47. In that configuration the presence of ski boot 41, for example, will exert enough pressure to create a leakage path of sufficiently low impedance to cause the output signal of inverter 75 to switch to its high state. Removal of, or greatly reducing the conducting path by removal of a ski boot from the binding, again causes the output signal of inverter 75 to assume its low output state, reversing the state of electronic switch 71. Thus, electronic switch 71 is controlled by whether or not a leakage path of the correct differential resistance is provided between terminals 77 and 79.

The invention has been described with reference to certain preferred embodiments. Those skilled in the art will recognize that various additions, substitutions and modifications may be made without departing from the spirit of the invention. Therefore, the scope of the invention is limited solely by the following claims.

Having described the above invention, the following is claimed:

1. In an electronic ski binding which includes a power supply, a transducer for measuring forces applied thereto, electronic processing circuitry for processing signals received from said transducer, and means acting in response to said processed signals, the improvement comprising the incorporation in said electronic ski binding of electronic switching means that is continuously supplied with power from said power supply, said switching means including an electronic switch and electronic switch control means, wherein said electronic switch comprises only stationary parts and said switch control means controls the open/closed state of said switch, and wherein said switch control means closes said switch in response to a predetermined, non-invasive external influence, thereby providing power from said power supply to said transducer and to said processing circuitry, thus activating the transducer and processing circuitry to perform their design function, said switch control means comprising a filter including an environmentally variable impedance means for changing a cut-off frequency of said filter in response to the application of said external influence, and latch means for maintaining a connection between said power supply and said circuitry when said external influence changes.

2. The invention of claim 1 wherein said environmentally variable impedance means comprises a capacitor having two conducting plates and an elastic dielectric disposed between said plates and wherein said external influence comprises pressure applied transverse to said plates.

3. The invention of claim 1 wherein said environmentally variable impedance means comprises a resistor having a resistance dependent upon the pressure applied to said resistor and wherein said external influence comprises pressure applied to said resistor.

4. In an electronic ski binding which includes a power supply, a transducer for measuring forces applied thereto, electronic processing circuitry for processing signals received from said transducer, and means acting in response to said processed signals, the improvement comprising the incorporation in said electronic ski binding of electronic switching means that is continuously supplied with power from said power supply, said switching means including an electronic switch and electronic switch control means, wherein said electronic switch comprises only stationary parts and said switch control means controls the open/closed state of said switch, and wherein said switch control means closes said switch in response to a predetermined, non-invasive external influence, thereby providing power from said power supply to said transducer and to said processing circuitry, thus activating the transducer and processing circuitry to perform their design function, wherein said electronic switch control means comprises an oscillator including an environmentally variable impedance means for changing the frequency of said oscillator in response to the application of said external influence, and latch means for maintaining a connection between said power supply and circuitry when said external influence changes.

5. The invention of claim 4 wherein said environmentally variable impedance means comprises a capacitor having two conducting plates and an elastic dielectric disposed between said plates and wherein said external influence comprises pressure applied transversely to said plates.

6. The invention of claim 4 wherein said environmental variable impedance means comprises a resistor having a resistance dependent upon the pressure applied to said resistor and wherein said external influence comprises pressure applied to said resistor.

* * * * *